US006575244B2

(12) United States Patent
Chang et al.

(10) Patent No.: US 6,575,244 B2
(45) Date of Patent: Jun. 10, 2003

(54) SYSTEM FOR CONTROLLING THE OPERATING PRESSURES WITHIN A SUBTERRANEAN BOREHOLE

(75) Inventors: Lingo Chang, Missouri City, TX (US); Roger Suter, Missouri City, TX (US); Alan Burkhard, Houston, TX (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 09/918,929

(22) Filed: Jul. 31, 2001

(65) Prior Publication Data

US 2003/0024737 A1 Feb. 6, 2003

(51) Int. Cl.[7] ..... E21B 21/08; E21B 44/00; E21B 47/06

(52) U.S. Cl. ..... 166/250.15; 166/250.07; 166/250.01; 166/66; 166/374; 175/25; 175/48; 73/152.22; 73/152.46

(58) Field of Search ..... 175/25, 48; 166/250.01, 166/250.07, 250.15, 370, 373, 374, 66; 73/152.51, 152.22, 152.46; 703/9, 10

(56) References Cited

U.S. PATENT DOCUMENTS 3,827,511 A * 8/1974 Jones ..... 166/91.1
3,971,926 A * 7/1976 Gau et al. ..... 708/3
4,253,530 A * 3/1981 Sharki et al. ..... 175/218
4,440,239 A * 4/1984 Evans ..... 175/38
5,182,703 A * 1/1993 Yamamoto ..... 700/37
5,517,593 A * 5/1996 Nenniger et al. ..... 166/250.11
6,286,602 B1 * 9/2001 Lemetayer et al. ..... 166/311
6,293,341 B1 * 9/2001 Lemetayer ..... 166/250.15

* cited by examiner

*Primary Examiner*—David Bagnell
*Assistant Examiner*—T. Shane Bomar
(74) *Attorney, Agent, or Firm*—Haynes and Boone LLP

(57) ABSTRACT

A borehole includes a tubular member, a sealing member for sealing an annulus between the tubular member and the borehole, a pump for pumping fluidic materials into the tubular member, and an automatic choke for controllably releasing pressurized fluidic materials out of the annulus. A system and method monitor the operating pressure within the tubular member and compare the actual operating pressure with a desired operating pressure. The difference between the actual and desired operating pressure is then processed to control the operation of the automatic choke to thereby controllably bleed pressurized fluidic materials out of the annulus thereby creating back pressure within the borehole.

43 Claims, 7 Drawing Sheets

SYSTEM FOR CONTROLLING THE OPERATING PRESSURES WITHIN A SUBTERRANEAN BOREHOLE

BACKGROUND

This invention relates generally to subterranean boreholes, and in particular to systems for controlling the operating pressures within subterranean boreholes.

Referring to FIG. 1, a typical oil or gas well 10 includes a wellbore 12 that traverses a subterranean formation 14 and includes a wellbore casing 16. During operation of the well 10, a drill pipe 18 may be positioned within the wellbore 12 in order to inject fluids such as, for example, drilling mud into the wellbore. As will be recognized by persons having ordinary skill in the art, the end of the drill pipe 18 may include a drill bit and the injected drilling mud may used to cool the drill bit and remove particles drilled away by the drill bit. A mud tank 20 containing a supply of drilling mud may be operably coupled to a mud pump 22 for injecting the drilling mud into the drill pipe 18. The annulus 24 between the wellbore casing 16 and the drill pipe 18 may be sealed in a conventional manner using, for example, a rotary seal 26. In order to control the operating pressures within the well 10 such as, for example, within acceptable ranges, a choke 28 may be operably coupled to the annulus 24 between the wellbore casing 16 and the drill pipe 18 in order to controllably bleed off pressurized fluidic materials out of the annulus 24 back into the mud tank 20 to thereby create back pressure within the wellbore 12. The choke 28 is manually controlled by a human operator 30 to maintain one or more of the following operating pressures within the well 10 within acceptable ranges: (1) the operating pressure within the annulus 24 between the wellbore casing 16 and the drill pipe 18—commonly referred to as the casing pressure (CSP); (2) the operating pressure within the drill pipe 18—commonly referred to as the drill pipe pressure (DPP); and (3) the operating pressure within the bottom of the wellbore 12—commonly referred to as the bottom hole pressure (BHP). In order to facilitate the manual human control 30 of the CSP, the DPP, and the BHP, sensors, 32*a*, 32*b*, and 32*c*, respectively, may be positioned within the well 10 that provide signals representative of the actual values for CSP, DPP, and/or BHP for display on a conventional display panel 34. Typically, the sensors, 32*a* and 32*b*, for sensing the CSP and DPP, respectively, are positioned within the annulus 24 and drill pipe 18, respectively, adjacent to a surface location. The operator 30 may visually observe one of the more operating pressures, CSP, DPP, and/or BHP, using the display panel 34 and attempt to manually maintain the operating pressures within predetermined acceptable limits by manually adjusting the choke 28. If the CSP, DPP, and/or the BHP are not maintained within acceptable ranges then an underground blowout can occur thereby potentially damaging the production zones within the subterranean formation 14. The manual operator control 30 of the CSP, DPP, and/or the BHP is imprecise, unreliable, and unpredictable. As a result, underground blowouts occur thereby diminishing the commercial value of many oil and gas wells.

The present invention is directed to overcoming one or more of the limitations of existing systems for controlling the operating pressures of subterranean boreholes.

SUMMARY

According to an embodiment of the present invention, a method of controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole is provided that includes sensing an operating pressure within the tubular member and generating an actual tubular member pressure signal representative of the actual operating pressure within the tubular member, comparing the actual tubular member pressure signal with a target tubular member pressure signal representative of a target operating pressure within the tubular member and generating an error signal representative of the difference between the actual tubular member pressure signal and the target tubular member pressure signal, and processing the error signal to generate a set point pressure signal for controlling the operation of the automatic choke.

The present embodiments of the invention provide a number of advantages. For example, the ability to control the DPP also permits control of the BHP. Furthermore, the use of a PID controller having lag compensation and/or feedforward control enhances the operational capabilities and accuracy of the control system. In addition, the monitoring of the system transient response and modeling the overall transfer function of the system permits the operation of the PID controller to be further adjusted to respond to perturbations in the system. Finally, the determination of convergence, divergence, or steady state offset between the overall transfer function of the system and the controlled variables permits further adjustment of the PID controller to permit enhanced control system response characteristics.

DESCRIPTION OF THE PREFERRED EMBODIMENTS

Figure 1:
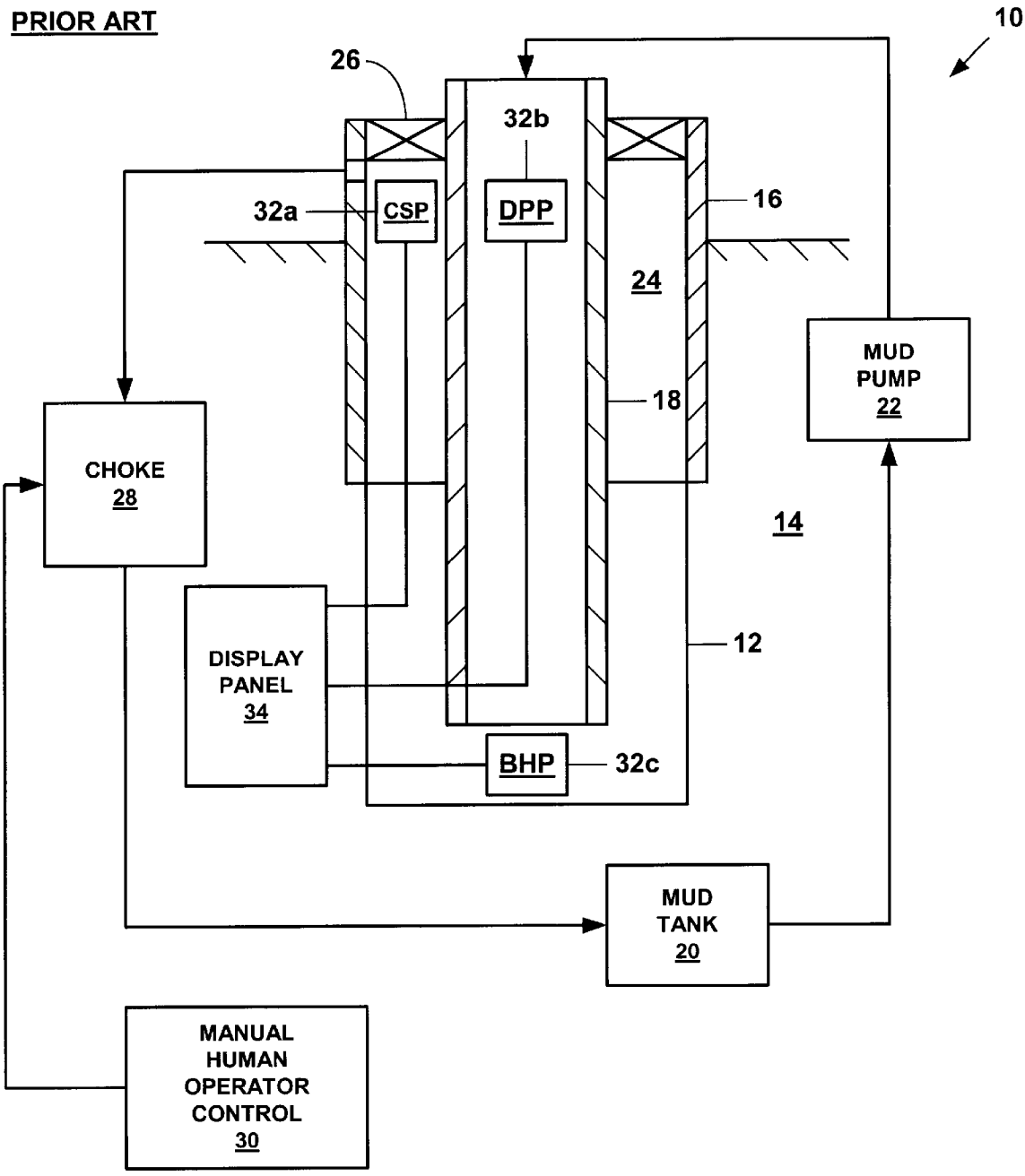
FIG. 1 is a schematic illustration of an embodiment of a conventional oil or gas well.
Figure 2:
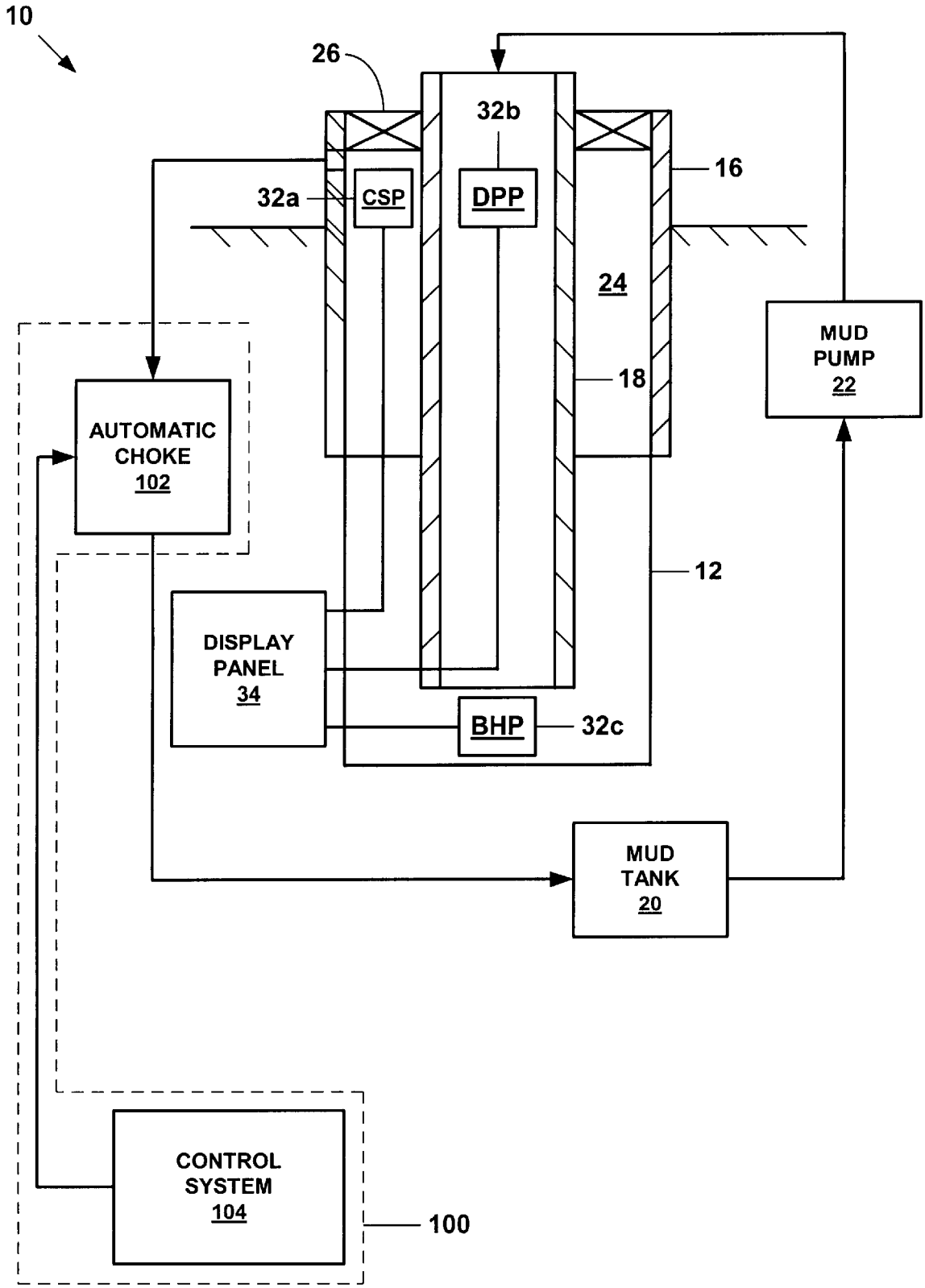
FIG. 2 is a schematic illustration of an embodiment of a system for controlling the operating pressures within a oil or gas well.
Figure 3:
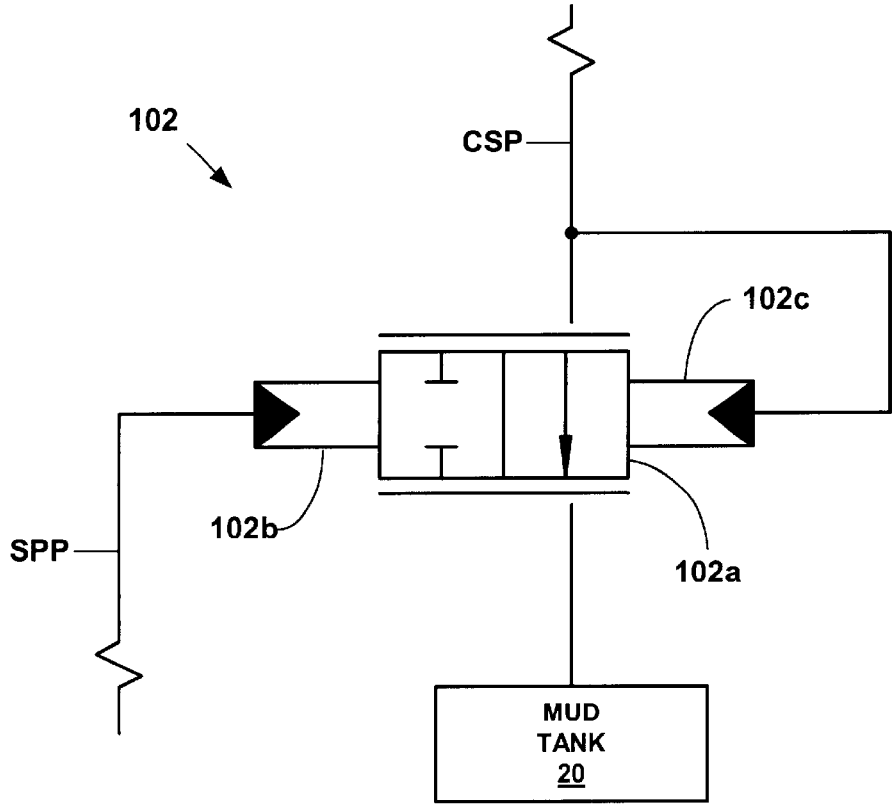
FIG. 3 is a schematic illustration of an embodiment of the automatic choke of the system of FIG. 2.
Figure 4:
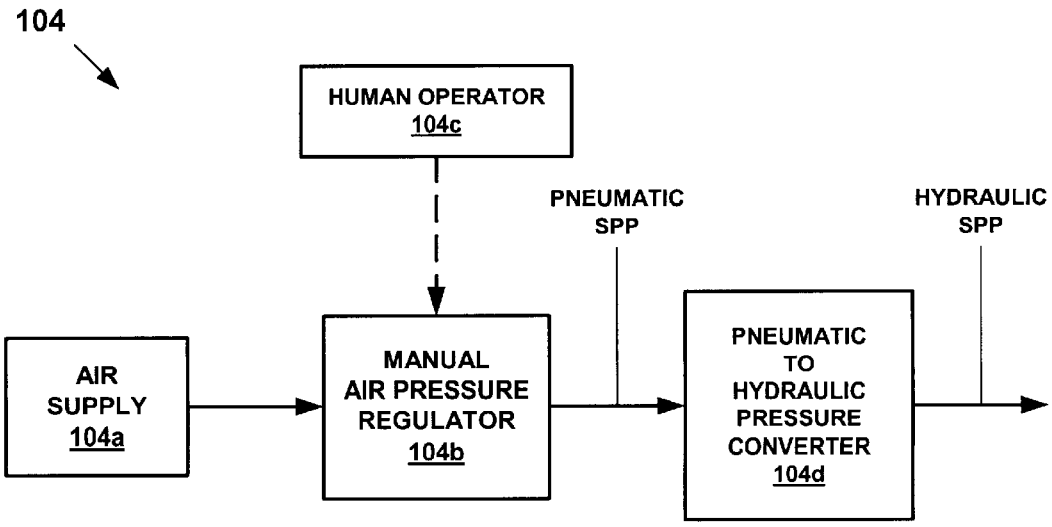
FIG. 4 is a schematic illustration of an embodiment of the control system of the system of FIG. 2.

Referring to FIGS. 2–4, the reference numeral 100 refers, in general, to an embodiment of a system for controlling the operating pressures within the oil or gas well 10 that includes an automatic choke 102 for controllably bleeding off the pressurized fluids from the annulus 24 between the wellbore casing 16 and the drill pipe 18 to the mud tank 20 to thereby create back pressure within the wellbore 12 and a control system 104 for controlling the operation of the automatic choke.

As illustrated in FIG. 3, the automatic choke 102 includes a movable valve element 102*a* that defines a continuously variable flow path depending upon the position of the valve element 102*a*. The position of the valve element 102*a* is controlled by a first control pressure signal 102*b*, and an opposing second control pressure signal 102*c*. In an exemplary embodiment, the first control pressure signal 102*b* is representative of a set point pressure (SPP) that is generated by the control system 104, and the second control pressure signal 102*c* is representative of the CSP. In this manner, if the CSP is greater than the SPP, pressurized fluidic materials within the annulus 24 of the well 10 are bled off into the mud tank 20. Conversely, if the CSP is equal to or less than the SPP, then the pressurized fluidic materials within the annulus 24 of the well 10 are not bled off into the mud tank 20. In this manner, the automatic choke 102 provides a pressure regulator than can controllably bleed off pressurized fluids from the annulus 24 and thereby also controllably create back pressure in the wellbore 12. In an exemplary embodiment, the automatic choke 102 is further provided substantially as described in U.S. Pat. No. 6,253,787, the disclosure of which is incorporated herein by reference.

As illustrated in FIG. 4, the control system 104 includes a conventional air supply 104*a* that is operably coupled to a conventional manually operated air pressure regulator 104*b* for controlling the operating pressure of the air supply. A human operator 104*c* may manually adjust the air pressure regulator 104*b* to generate a pneumatic SPP. The pneumatic SPP is then converted to a hydraulic SPP by a conventional pneumatic to hydraulic pressure converter 104*d*. The hydraulic SPP is then used to control the operation of the automatic choke 102.

Thus, the system 100 permits the CSP to be automatically controlled by the human operator 104*c* selecting the desired SPP. The automatic choke 102 then regulates the CSP as a function of the selected SPP.

Figure 5:
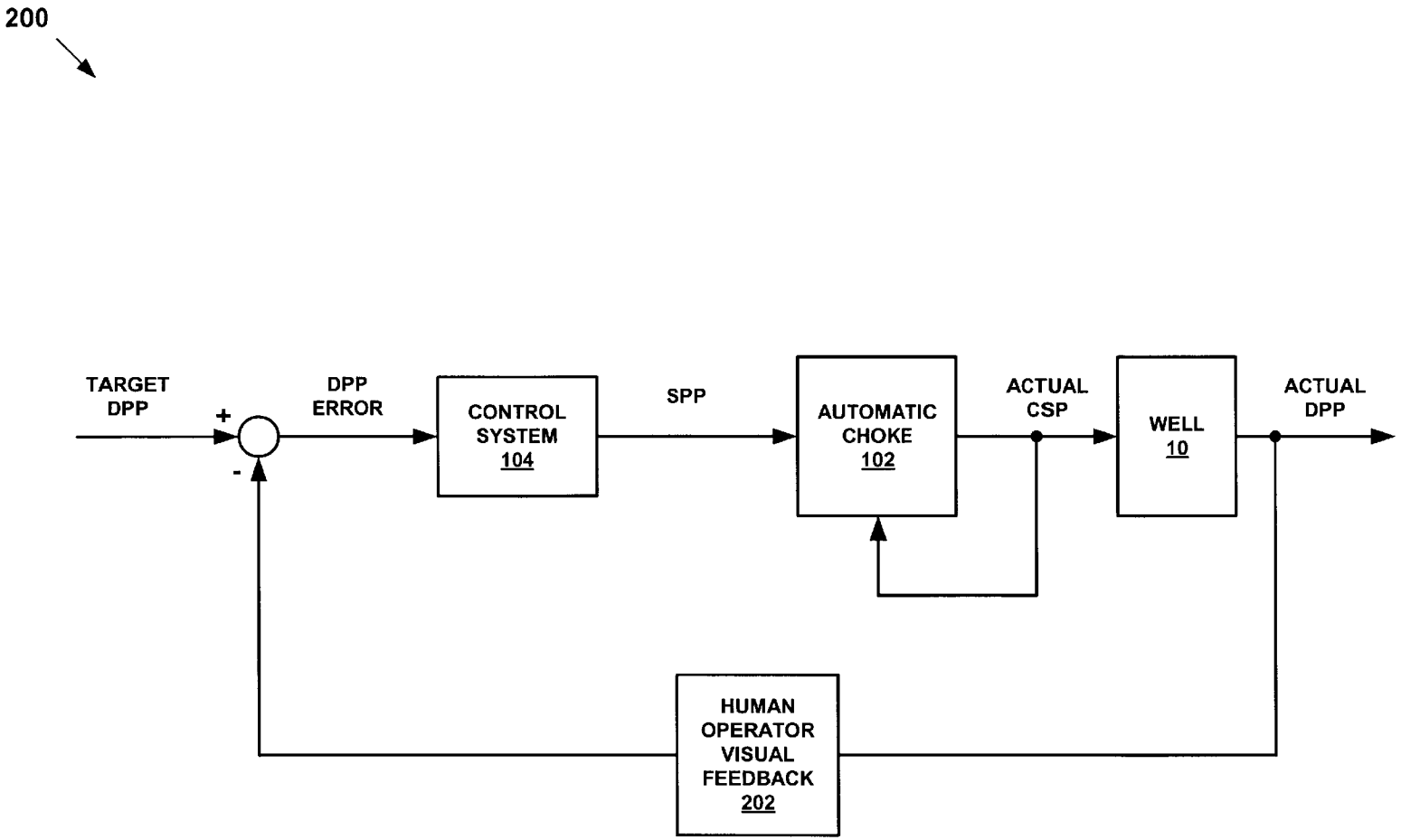
FIG. 5 is a schematic illustration of another embodiment of a system for controlling the operating pressures within an oil or gas well.

Referring to FIG. 5, an alternative embodiment of a system 200 for controlling the operating pressures within the oil or gas well 10 includes a human operator visual feedback 202 that monitors the actual DPP value within the drill pipe 18 using the display panel 34. The actual DPP value is then read by the human operator 202 and compared with a predetermined target DPP value by the human operator to determine the error in the actual DPP. The control system 104 may then be manually operated by a human operator to adjust the SPP as a function of the amount of error in the actual DPP. The adjusted SPP is then processed by the automatic choke 102 to control the actual CSP. The actual CSP then is processed by the well 10 to adjust the actual DPP. Thus, the system 200 maintains the actual DPP within a predetermined range of acceptable values. Furthermore, because there is a closer correlation between DPP and BHP than between CSP and BHP, the system 200 is able to control the BHP more effectively than the system 100.

Figure 6:
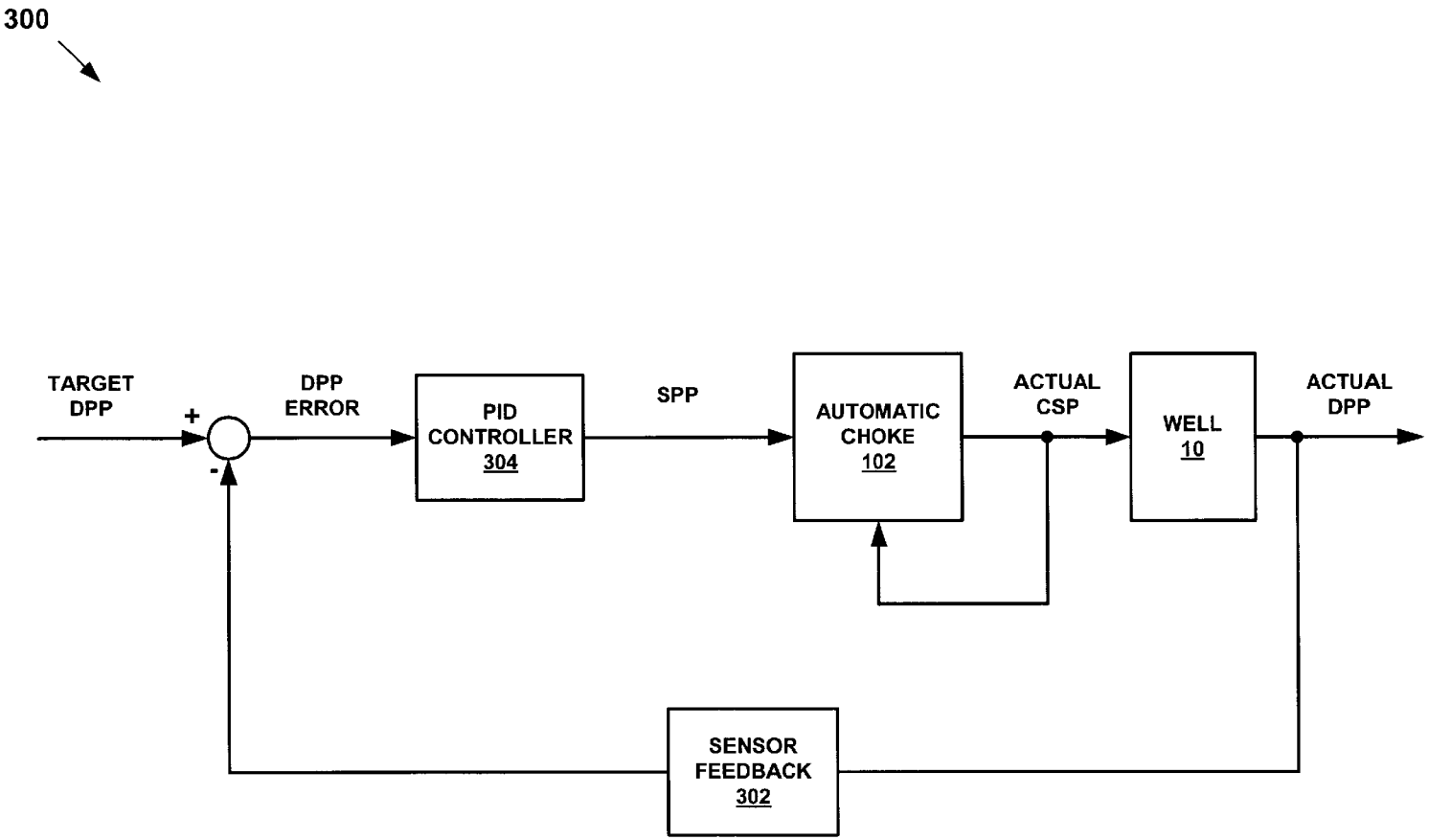
FIG. 6 is a schematic illustration of another embodiment of a system for controlling the operating pressures within an oil or gas well.

Referring to FIG. 6, another alternative embodiment of a system 300 for controlling the operating pressures within the oil or gas well 10 includes a sensor feedback 302 that monitors the actual DPP value within the drill pipe 18 using the output signal of the sensor 32*b*. The actual DPP value provided by the sensor feedback 302 is then compared with the target DPP value to generate a DPP error that is processed by a proportional-integral-differential (PID) controller 304 to generate an hydraulic SPP.

As will be recognized by persons having ordinary skill in the art, a PID controller includes gain coefficients, Kp, Ki, and Kd, that are multiplied by the error signal, the integral of the error signal, and the differential of the error signal, respectively. In an exemplary embodiment, the PID controller 304 also includes a lag compensator and/or feedforward control. In an exemplary embodiment, the lag compensator is directed to: (1) compensating for lags due to the wellbore fluid pressure dynamics (i.e., a pressure transient time (PTT) lag); and/or (2) compensating for lags due to the response lag between the input to the automatic choke 102 (i.e., the numerical input value for SPP provided by the PID controller 304) and the output of the automatic choke (i.e., the resulting CSP). The PTT refers to the amount of time for a pressure pulse, generated by the opening or closing of the automatic choke 102, to travel down the annulus 24 and back up the interior of the drill pipe 18 before manifesting itself by altering the DPP at the surface. The PTT further varies, for example, as a function of: (1) the operating pressures in the well 10; (2) the kick fluid volume, type, and dispersion; (3) the type and condition of the mud; and (4) the type and condition of the subterranean formation 14.

As will be recognized by persons having ordinary skill in the art, feedforward control refers to a control system in which set point changes or perturbations in the operating environment can be anticipated and processed independent of the error signal before they can adversely affect the process dynamics. In an exemplary embodiment, the feedforward control anticipates changes in the SPP and/or perturbations in the operating environment for the well 10.

The hydraulic SPP is then processed by the automatic choke 102 to control the actual CSP. The actual CSP is then processed by the well 10 to adjust the actual DPP. Thus, the system 300 maintains the actual DPP within a predetermined range of acceptable values. Furthermore, because the PID controller 304 of the system 300 is more responsive, accurate, and reliable than the control system 104 of the system 200, the system 300 is able to control the DPP and BHP more effectively than the system 200.

Figure 7:
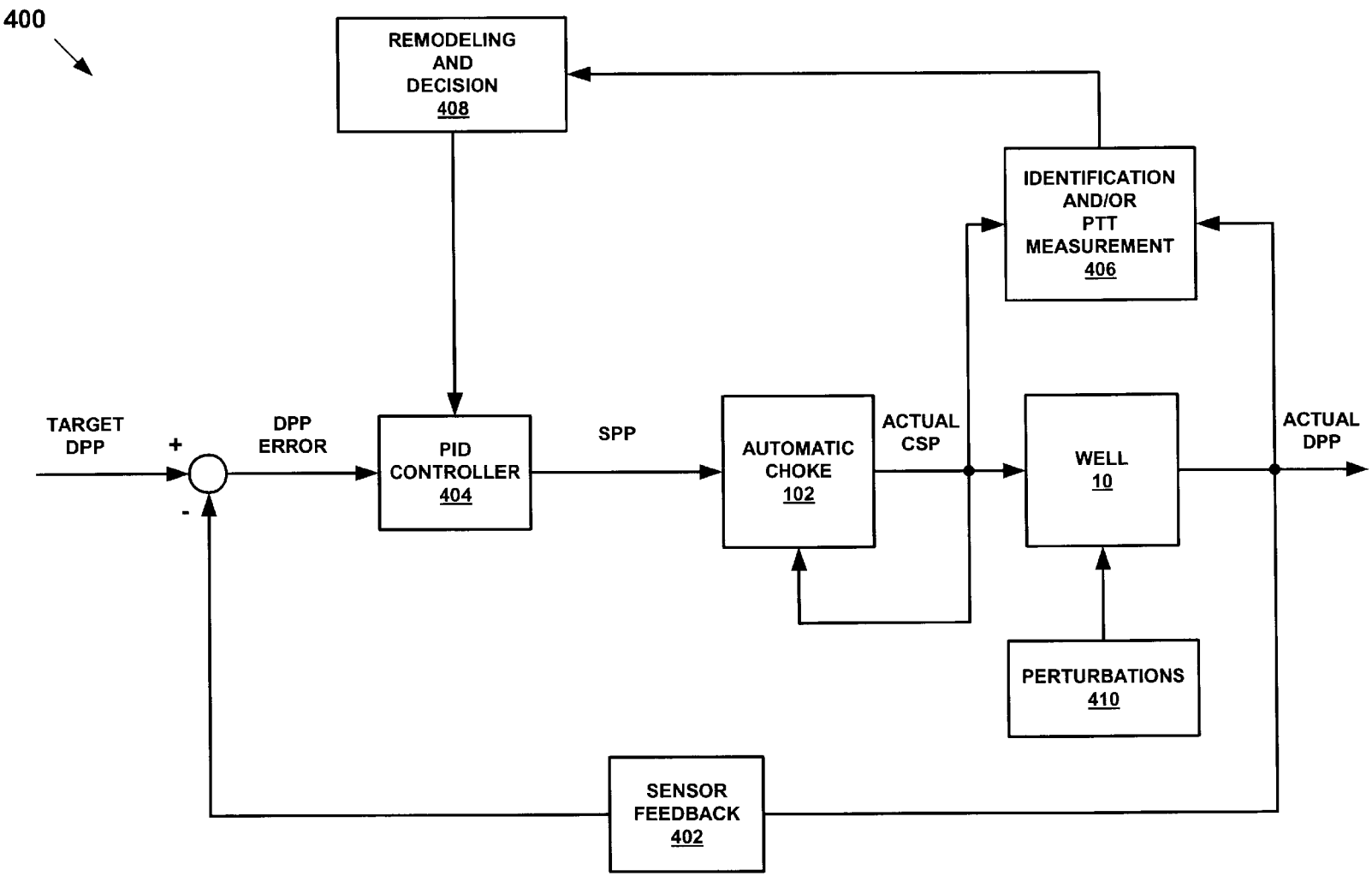
FIG. 7 is a schematic illustration of another embodiment of a system for controlling the operating pressures within an oil or gas well.

Referring to FIG. 7, an embodiment of an adaptive system 400 for controlling the operating pressures within the oil or gas well 10 includes a sensor feedback 402 that monitors the actual DPP value within the drill pipe 18 using the output signal of the sensor 32*b*. The actual DPP value provided by the sensor feedback 402 is then compared with the target DPP value to generate a DPP error that is processed by a proportional-integral-differential (PID) controller 404 to generate an hydraulic SPP. In an exemplary embodiment, the PID controller 404 further includes a lag compensator and/or feedforward control. In an exemplary embodiment, the lag compensator is directed to: (1) compensating for lags due to the wellbore fluid pressure dynamics (i.e., the pressure transient time lag); and/or (2) compensating for lags due to the response lag between the input to the automatic choke 102 (i.e., the numerical input value for SPP provided by the PID controller 404) and the output of the automatic choke (i.e., the resulting CSP). In an exemplary embodiment, the feedforward control anticipates changes in the SPP and/or perturbations in the operating environment for the well 10.

The hydraulic SPP is then processed by the automatic choke 102 to control the actual CSP. The actual CSP is then processed by the well 10 to adjust the actual DPP. An identification and/or pressure transient time (PTT) measurement control block 406 monitors the actual CSP and/or DPP in order to: (1) quantify the controlled parameters of the system 400 based upon past input and output responses in order to determine the transient behavior of the CSP and/or DPP; and/or (2) determine the PTT.

The identification and/or PTT measurements are then processed by a remodeling and decision control block 408 in order to adaptively modify the gain coefficients of the PID controller 404. In particular, the remodeling and decision control block 408 processes the identification and/or PTT measurements provided by the identification and/or PTT measurement control block 406 to generate a model of the overall transfer function for the system 400 and determine how that model may be modified to improve the overall performance of the system. The gain coefficients of the PID controller 404 are then adjusted by the remodeling and decision control block 408 in order to improve the overall performance of the system.

In an exemplary embodiment, the PID controller 404, the identification and/or PTT measurement control block 406, and remodeling and decision control block 408 are provided by a programmable controller that implements corresponding control software and includes conventional input and output signal processing such as, for example, digital to analog (D/A) and analog to digital (A/D) conversion.

Thus, the system 400 characterizes the transient behavior of the CSP and/or the DPP and then updates the modeling of the overall transfer function for the system. Based upon the updated model of the overall transfer function for the system 400, the system 400 then modifies the gain coefficients for the PID controller 404 in order to optimally control the DPP and BHP. In this manner, the system 400 is highly effective at adaptively controlling the DPP and BHP to thereby respond to perturbations 410 that may act upon the well 10.

Figure 8:
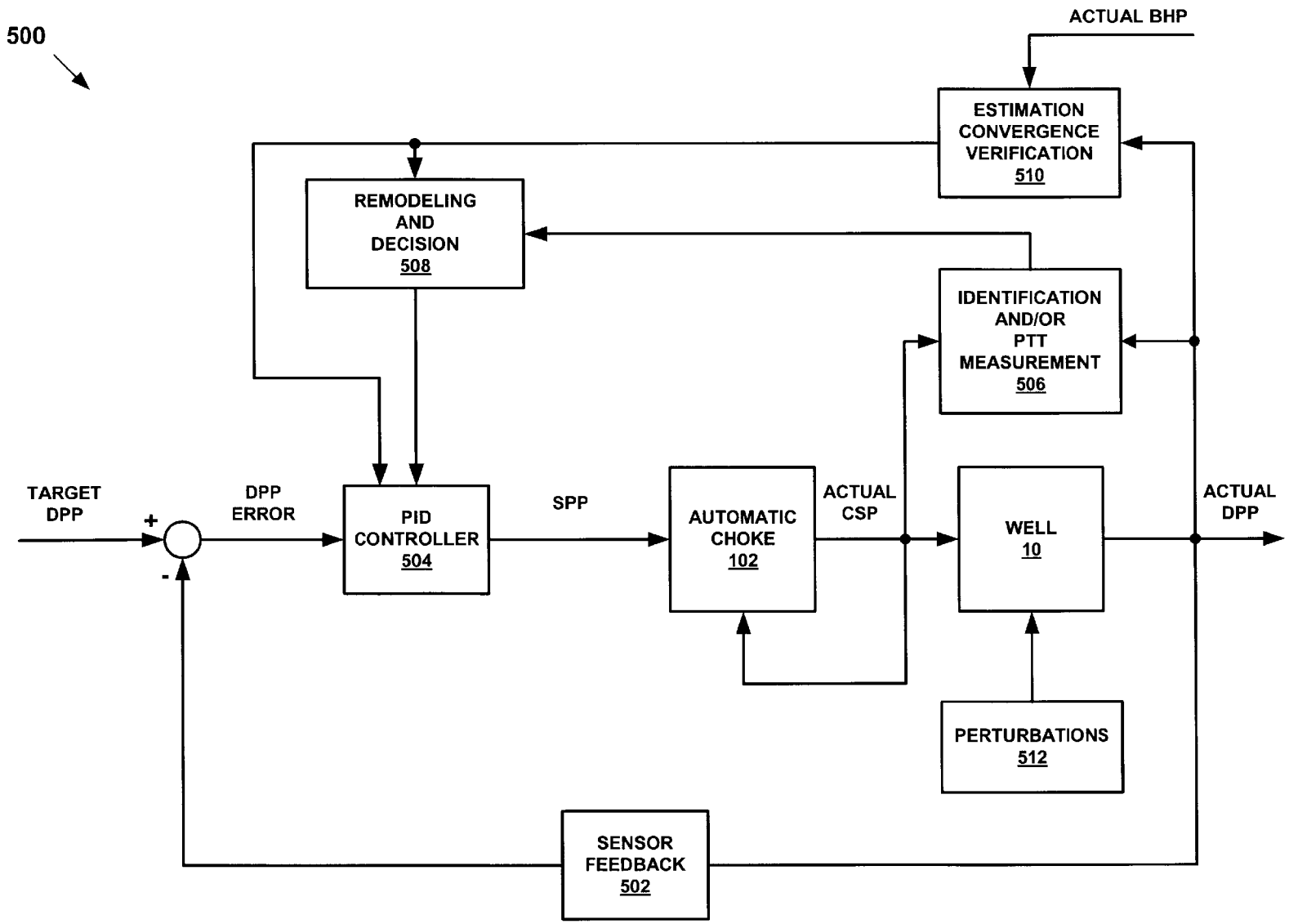
FIG. 8 is a schematic illustration of another embodiment of a system for controlling the operating pressures within an oil or gas well.

Referring to FIG. 8, an alternative embodiment of an adaptive system 500 for controlling the operating pressures within the oil or gas well 10 includes a sensor feedback 502 that monitors the actual DPP value within the drill pipe 18 using the output signal of the sensor 32*b*. The actual DPP value provided by the sensor feedback 502 is then compared with the target DPP value to generate a DPP error that is processed by a proportional-integral-differential (PID) controller 504 to generate an hydraulic SPP. In an exemplary embodiment, the PID controller 504 further includes a lag compensator and/or feedforward control. In an exemplary embodiment, the lag compensator is directed to: (1) compensating for lags due to the wellbore fluid pressure dynamics (i.e., the pressure transient time lag); and/or (2) compensating for lags due to the response lag between the input to the automatic choke 102 (i.e., the numerical input value for SPP provided by the PID controller 504) and the output of the automatic choke (i.e., the resulting CSP). In an exemplary embodiment, the feedforward control anticipates changes in the SPP and/or perturbations in the operating environment for the well 10.

The hydraulic SPP is then processed by the automatic choke 102 to control the actual CSP. The actual CSP is then processed by the well 10 to adjust the actual DPP. An identification and/or pressure transient time (PTT) measurement control block 506 is also provided that monitors the actual CSP and/or DPP in order to: (1) quantify the parameters of the system 500 related to the transient behavior of the system; and/or (2) determine the PTT.

The identification and/or PTT measurements are then processed by a remodeling and decision control block 508 in order to adaptively modify the gain coefficients of the PID controller 504. In particular, the remodeling and decision control block 508 processes the identification and/or PTT measurements provided by the identification and/or PTT measurement control block 506 to generate a model of the overall transfer function for the system 500 and determine how that model may be modified to improve the overall performance of the system. The gain coefficients of the PID controller 504 are then adjusted by the remodeling and decision control block 508 in order to improve the overall performance of the system.

An estimation, convergence, and verification control block 510 is also provided that monitors the actual BHP value using the output signal of the sensor 32*c* in order to compare the theoretical response of the system 500 with the actual response of the system and thereby determine if the theoretical response of the system is converging toward or diverging from the actual response of the system. If the estimation, convergence, and verification control block 510 determines that there is convergence, divergence or a steady state offset between the theoretical and actual response of the system 500, then the estimation, convergence, and verification control block may then modify the operation of the PID controller 504 and the remodeling and decision control block 508.

In an exemplary embodiment, the PID controller 504, the identification and/or PTT measurement control block 506, the remodeling and decision control block 508, and the estimation, convergence and verification control block 510 are provided by a programmable controller that implements corresponding control software and includes conventional input and output signal processing such as, for example, D/A and A/D conversion.

Thus, the system 500 characterizes the transient behavior of the CSP and/or the DPP and then updates the modeling of the overall transfer function for the system. Based upon the updated model of the overall transfer function for the system, the system 500 then modifies the gain coefficients for the PID controller 504 in order to optimally control the DPP and BHP. The system 500 further adjusts the gain coefficients of the PID controller 504 and the modeling of the overall transfer function of the system as a function of the degree of convergence, divergence, or steady state offset between the theoretical and actual response of the system. In this manner, the system 500 is more effective at adaptively controlling the DPP and BHP to thereby respond to perturbations 512 that may act upon the well 10 than the system 400.

As will be recognized by persons having ordinary skill in the art, having the benefit of the present disclosure, the operation of placing a tubular member into a subterranean borehole is common to the formation and/or operation of, for example, oil and gas wells, mine shafts, underground structural supports, and underground pipelines. Furthermore, as will also be recognized by persons having ordinary skill in the art, having the benefit of the present disclosure, the operating pressures within subterranean structures such as, for example, oil and gas wells, mine shafts, underground structural supports and underground pipelines, typically must be controlled before, during, or after their formation. Thus, the teachings of the present disclosure may be used to control the operating pressures within subterranean structures such as, for example, oil and gas wells, mine shafts, underground structural supports, and underground pipelines.

The present embodiments of the invention provide a number of advantages. For example, the ability to control the DPP also permits control of the BHP. Furthermore, the use of a PID controller having lag compensating and/or feedforward control enhances the operational capabilities and accuracy of the control system. In addition, the monitoring of the system transient response and modeling the overall transfer function of the system permits the operation of the PID controller to be further adjusted to respond to perturbations in the system. Finally, the determination of convergence, divergence, or steady state offset between the overall transfer function of the system and the controlled variables permits further adjustment of the PID controller to permit enhanced response characteristics.

It is understood that variations may be made in the foregoing without departing from the scope of the invention. For example, any choke capable of being controlled with a set point signal may be used in the systems 100, 200, 300, 400, and 500. Furthermore, the automatic choke 102 may be controlled by a pneumatic, hydraulic, electric, and/or a hybrid actuator and may receive and process pneumatic, hydraulic, electric, and/or hybrid set point and control signals. In addition, the automatic choke 102 may also include an embedded controller that provides at least part of the remaining control functionality of the systems 300, 400, and 500. Furthermore, the PID controllers, 304, 404, and 504 and the control blocks, 406, 408, 506, 508, and 510 may, for example, be analog, digital, or a hybrid of analog and digital, and may be implemented, for example, using a programmable general purpose computer, or an application specific integrated circuit. Finally, as discussed above, the teachings of the systems 100, 200, 300, 400 and 500 may be applied to the control of the operating pressures within any borehole formed within the earth including, for example, a oil or gas production well, an underground pipeline, a mine shaft, or other subterranean structure in which it is desirable to control the operating pressures.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A method of controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

sensing an operating pressure within the tubular member and generating an actual tubular member pressure signal representative of the actual operating pressure within the tubular member;

comparing the actual tubular member pressure signal with a target tubular member pressure signal representative of a target operating pressure within the tubular member and generating an error signal representative of the difference between the actual tubular member pressure signal and the target tubular member pressure signal; and processing the error signal to generate a set point pressure signal for controlling the operation of the automatic choke, wherein processing the error signal comprises: multiplying the error signal by a gain $K_p$;

integrating the error signal and multiplying the integral of the error signal by a gain $K_i$; and differentiating the error signal and multiplying the differential of the error signal by a gain $K_d$.

2. A method of controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

sensing an operating pressure within the tubular member and generating an actual tubular member pressure signal representative of the actual operating pressure within the tubular member;

comparing the actual tubular member pressure signal with a target tubular member pressure signal representative of a target operating pressure within the tubular member and generating an error signal representative of the difference between the actual tubular member pressure signal and the target tubular member pressure signal; and processing the error signal to generate a set point pressure signal for controlling the operation of the automatic choke, wherein the processing comprises compensating for a time lag.

3. The method of claim 2, wherein the time lag comprises:

a pressure transient time lag.

4. The method of claim 2, wherein the time lag comprises:

a time lag between a generation of the target tubular member pressure signal and a corresponding operation of the automatic choke.

5. A method of controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

sensing an operating pressure within the tubular member and generating an actual tubular member pressure signal representative of the actual operating pressure within the tubular member;

comparing the actual tubular member pressure signal with a target tubular member pressure signal representative of a target operating pressure within the tubular member and generating an error signal representative of the difference between the actual tubular member pressure signal and the target tubular member pressure signal; and processing the error signal to generate a set point pressure signal for controlling the operation of the automatic choke, wherein the processing comprises anticipating changes in the target tubular member pressure signal.

6. A method of controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

sensing an operating pressure within the tubular member and generating an actual tubular member pressure signal representative of the actual operating pressure within the tubular member;

comparing the actual tubular member pressure signal with a target tubular member pressure signal representative of a target operating pressure within the tubular member and generating an error signal representative of the difference between the actual tubular member pressure signal and the target tubular member pressure signal; and processing the error signal to generate a set point pressure signal for controlling the operation of the automatic choke, wherein the processing comprises anticipating perturbations in the borehole.

7. A method of controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

sensing an operating pressure within the tubular member and generating an actual tubular member pressure signal representative of the actual operating pressure within the tubular member;

comparing the actual tubular member pressure signal with a target tubular member pressure signal representative of a target operating pressure within the tubular member and generating an error signal representative of the difference between the actual tubular member pressure signal and the target tubular member pressure signal;

processing the error signal to generate a set point pressure signal for controlling the operation of the automatic choke;

determining a transient response of one or more operating parameters within the borehole;

modeling the transfer function of the borehole as a function of the determined transient response; and modifying the processing of the error signal as a function of the modeled transfer function of the borehole.

8. The method of claim 7, wherein the operating parameters comprise:

the actual operating pressure within the tubular member.

9. The method of claim 7, wherein the operating parameters comprise:

an actual operating pressure within the annulus between the tubular member and the borehole.

10. The method of claim 7, wherein the operating parameters comprise:

a pressure transient time.

11. The method of claim 7, further comprising:

determining an actual operating pressure within the bottom of the borehole;

comparing the operating pressure within the bottom of the borehole with a theoretical value of the operating pressure within the borehole generated by the modeled transfer function of the borehole; and modifying the processing of the error signal as a function of the comparison.

12. The method of claim 11, further comprising:

determining if the actual operating pressure within the bottom of the borehole and the theoretical operating pressure within the bottom of the borehole are converging; and modifying the processing of the error signal as a function of the convergence.

13. The method of claim 11, further comprising:

determining if the actual operating pressure within the bottom of the borehole and the theoretical operating pressure within the bottom of the borehole are diverging; and modifying the processing of the error signal as a function of the divergence.

14. The method of claim 11, further comprising:

determining if there is a steady state offset between the actual operating pressure within the bottom of the borehole and the theoretical operating pressure; and modifying the processing of the error signal as a function of the steady state offset.

15. A system for controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

means for sensing an operating pressure within the tubular member and generating an actual tubular member pressure signal representative of the actual operating pressure within the tubular member;

means for comparing the actual tubular member pressure signal with a target tubular member pressure signal representative of a target operating pressure within the tubular member and generating an error signal representative of the difference between the actual tubular member pressure signal and the target tubular member pressure signal; and means for processing the error signal to generate a set point pressure signal for controlling the operation of the automatic choke, wherein the means for processing the error signal comprises:

means for multiplying the error signal by a gain $K_p$;

means for integrating the error signal and multiplying the integral of the error signal by a gain $K_i$; and means for differentiating the error signal and multiplying the differential of the error signal by a gain $K_d$.

16. A system for controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

means for sensing an operating pressure within the tubular member and generating an actual tubular member pressure signal representative of the actual operating pressure within the tubular member;

means for comparing the actual tubular member pressure signal with a target tubular member pressure signal representative of a target operating pressure within the tubular member and generating an error signal representative of the difference between the actual tubular member pressure signal and the target tubular member pressure signal; and means for processing the error signal to generate a set point pressure signal for controlling the operation of the automatic choke, wherein the means for processing the error signal comprises means for compensating for a time lag.

17. The system of claim 16, wherein the time lag comprises:

a pressure transient time lag.

18. The system of claim 16, wherein the time lag comprises:

a time lag between a generation of the target tubular member pressure signal and a corresponding operation of the automatic choke.

19. A system for controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

means for sensing an operating pressure within the tubular member and generating an actual tubular member pressure signal representative of the actual operating pressure within the tubular member;

means for comparing the actual tubular member pressure signal with a target tubular member pressure signal representative of a target operating pressure within the tubular member and generating an error signal representative of the difference between the actual tubular member pressure signal and the target tubular member pressure signal; and means for processing the error signal to generate a set point pressure signal for controlling the operation of the automatic choke, wherein the means for processing the error signal comprises means for anticipating changes in the target tubular member pressure signal.

20. A system for controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

means for sensing an operating pressure within the tubular member and generating an actual tubular member pressure signal representative of the actual operating pressure within the tubular member;

means for comparing the actual tubular member pressure signal with a target tubular member pressure signal representative of a target operating pressure within the tubular member and generating an error signal representative of the difference between the actual tubular member pressure signal and the target tubular member pressure signal; and means for processing the error signal to generate a set point pressure signal for controlling the operation of the automatic choke, wherein the means for processing the error signal comprises means for anticipating perturbations in the borehole.

21. A system for controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

means for sensing an operating pressure within the tubular member and generating an actual tubular member pressure signal representative of the actual operating pressure within the tubular member;

means for comparing the actual tubular member pressure signal with a target tubular member pressure signal representative of a target operating pressure within the tubular member and generating an error signal representative of the difference between the actual tubular member pressure signal and the target tubular member pressure signal;

means for processing the error signal to generate a set point pressure signal for controlling the operation of the automatic choke;

means for determining a transient response of one or more operating parameters within the borehole;

means for modeling the transfer function of the borehole as a function of the determined transient response; and means for modifying the processing of the error signal as a function of the modeled transfer function of the borehole.

22. The system of claim 21, wherein the operating parameters comprise:

the actual operating pressure within the tubular member.

23. The system of claim 21, wherein the operating parameters comprise:

an actual operating pressure within the annulus between the tubular member and the borehole.

24. The system 21, wherein the operating parameters comprise:

a pressure transient time.

25. The system of claim 21, further comprising:

means for determining an actual operating pressure within the bottom of the borehole;

means for comparing the operating pressure within the bottom of the borehole with a theoretical value of the operating pressure within the borehole generated by the modeled transfer function of the borehole; and means for modifying the processing of the error signal as a function of the comparison.

26. The system of claim 25, further comprising:

means for determining if the actual operating pressure within the bottom of the borehole and the theoretical operating pressure within the bottom of the borehole are converging; and means for modifying the processing of the error signal as a function of the convergence.

27. The system of claim 25, further comprising:

means for determining if the actual operating pressure within the bottom of the borehole and the theoretical operating pressure within the bottom of the borehole are diverging; and means for modifying the processing of the error signal as a function of the divergence.

28. The system of claim 25, further comprising:

means for determining if there is a steady state offset between the actual operating pressure within the bottom of the borehole and the theoretical operating pressure; and means for modifying the processing of the error signal as a function of the steady state offset.

29. A system for controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

a sensor for sensing an operating pressure within the tubular member and generating an actual tubular member pressure signal representative of the actual operating pressure within the tubular member;

a comparator for comparing the actual tubular member pressure signal with a target tubular member pressure signal representative of a target operating pressure within the tubular member and generating an error signal representative of the difference between the actual tubular member pressure signal and the target tubular member pressure signal; and a processor for processing the error signal to generate a set point pressure signal for controlling the operation of the automatic choke, wherein the processor comprises:

a multiplier for multiplying the error signal by a gain $K_p$;

an integrator for integrating the error signal and multipliying the integral of the error signal by a gain $K_i$; and a differentiator for differentiating the error signal and multiplying the differential of the error signal by a gain $K_d$.

30. A system for controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

a sensor br sensing an operating pressure within the tubular member and generating an actual tubular member pressure signal representative of the actual operating pressure within the tubular member;

a comparator for comparing the actual tubular member pressure signal with a target tubular member pressure signal representative of a target operating pressure within the tubular member and generating an error signal representative of the difference between the actual tubular member pressure signal and the target tubular member pressure signal; and a processor for processing the error signal to generate a set point pressure signal for controlling the operation of the automatic choke, wherein the processor comprises a lag compensator for compensating for a time lag.

31. The system of claim 30, wherein the time lag comprises:

a pressure transient time lag.

32. The system of claim 30, wherein the time lag comprises:

a time lag between a generation of the target tubular member pressure signal and a corresponding operation of the automatic choke.

33. A system for controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

a sensor for sensing an operating pressure within the tubular member and generating an actual tubular member pressure signal representative of the actual operating pressure within the tubular member;

a comparator for comparing the actual tubular member pressure signal with a target tubular member pressure signal representative of a target operating pressure within the tubular member and generating an error signal representative of the difference between the actual tubular member pressure signal and the target tubular member pressure signal; and a processor for processing the error signal to generate a set point pressure signal for controlling the operation of the automatic choke, wherein the processor comprises a feedforward control for anticipating changes in the target tubular member pressure signal.

34. A system for controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

a sensor for sensing an operating pressure within the tubular member and generating an actual tubular member pressure signal representative of the actual operating pressure within the tubular member;

a comparator for comparing the actual tubular member pressure signal with a target tubular member pressure signal representative of a target operating pressure within the tubular member and generating an error signal representative of the difference between the actual tubular member pressure signal and the target tubular member pressure signal; and a processor for processing the error signal to generate a set point pressure signal for controlling the operation of the automatic choke, wherein processor comprises a feedforward control for anticipating perturbations in the borehole.

35. A system for controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

a sensor for sensing an operating pressure within the tubular member and generating an actual tubular member pressure signal representative of the actual operating pressure within the tubular member;

a comparator for comparing the actual tubular member pressure signal with a target tubular member pressure signal representative of a target operating pressure within the tubular member and generating an error signal representative of the difference between the actual tubular member pressure signal and the target tubular member pressure signal;

a processor for processing the error signal to generate a set point pressure signal for controlling the operation of the automatic choke;

a control element for determining a transient response of one or more operating parameters within the borehole;

a control element for modeling the transfer function of the borehole as a function of the determined transient response; and a control element for modifying the processing of the error signal by the processor as a function of the modeled transfer function of the borehole.

36. The system of claim 35, wherein the operating parameters comprise:

the actual operating pressure within the tubular member.

37. The system of claim 35, wherein the operating parameters comprise:

an actual operating pressure within the annulus between the tubular member and the borehole.

38. The system of claim 35, wherein the operating parameters comprise:

a pressure transient time.

39. The system of claim 35, further comprising:

a sensor for determining an actual operating pressure within the bottom of the borehole;

a control element for comparing the operating pressure within the bottom of the borehole with a theoretical value of the operating pressure within the borehole generated by the modeled transfer function of the borehole; and a control element for modifying the processing of the error signal by the processor as a function of the comparison.

40. The system of claim 39, further comprising:

a control element for determining if the actual operating pressure within the bottom of the borehole and the theoretical operating pressure within the bottom of the borehole are converging; and a control element for modifying the processing of the error signal by the processor as a function of the convergence.

41. The system of claim 39, further comprising:

a control element for determining if the actual operating pressure within the bottom of the borehole and the theoretical operating pressure within the bottom of the borehole are diverging; and a control element for modifying the processing of the error signal by the processor as a function of the divergence.

42. The system of claim 39, further comprising:

a control element for determining if there is a steady state offset between the actual operating pressure within the bottom of the borehole and the theoretical operating pressure; and a control element for modifying the processing of the error signal by the processor as a function of the steady state offset.

43. A method of controlling one or more operating pressures within a subterranean borehole that includes a tubular member positioned within the borehole that defines an annulus between the tubular member and the borehole, a sealing member for sealing the annulus between the tubular member and the borehole, a pump for pumping fluidic materials into the tubular member, and an automatic choke for controllably releasing fluidic materials out of the annulus between the tubular member and the borehole, comprising:

sensing an operating pressure within the tubular member and generating an actual tubular member pressure signal representative of the actual operating pressure within the tubular member;

comparing the actual tubular member pressure signal with a target tubular member pressure signal representative of a target operating pressure within the tubular member and generating an error signal representative of the difference between the actual tubular member pressure signal and the target tubular member pressure signal; and processing the error signal to generate a hydraulic set point pressure, the set point pressure being processed by the automatic choke to control the actual pressure in the annulus, and the actual pressure in the annulus being processed to adjust the actual tubular member pressure.

* * * * *